US007211756B2

(12) United States Patent
Balaban et al.

(10) Patent No.: US 7,211,756 B2
(45) **Date of Patent: *May 1, 2007**

(54) FOUR FUNCTION ELECTRICAL ROCKER SWITCH

(75) Inventors: David B. Balaban, Hauppauge, NY (US); Anthony Tufano, North Massapequa, NY (US)

(73) Assignee: Leviton Manufacturing Co., Inc., Little Neck, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/126,716

(22) Filed: May 11, 2005

(65) Prior Publication Data

US 2005/0211539 A1 Sep. 29, 2005

Related U.S. Application Data

(63) Continuation of application No. 10/047,246, filed on Jan. 14, 2002, now Pat. No. 6,903,292, which is a continuation-in-part of application No. 09/235,785, filed on Jan. 22, 1999, now Pat. No. 6,339,201, which is a continuation-in-part of application No. 08/865,921, filed on May 30, 1997, now abandoned.

(51) Int. Cl.
*H01H 21/00* (2006.01)

(52) U.S. Cl. ..... 200/339; 200/559

(58) Field of Classification Search ..... 200/1 R, 200/5 R, 6 R–6 C, 17 R, 18, 339, 553, 558–561
See application file for complete search history.

(56) References Cited

U.S. PATENT DOCUMENTS

| | | | | |
|---|---|---|---|---|
| 2,972,663 | A | 2/1961 | Zanichkowsky et al. | |
| 3,225,156 | A | 12/1965 | Sahrbacker | |
| 3,227,860 | A | 1/1966 | Sorenson | |
| 3,591,747 | A | 7/1971 | Dennison | |
| 4,022,999 | A * | 5/1977 | Brown | 200/437 |
| 4,336,429 | A | 6/1982 | Jackason et al. | |
| 4,689,450 | A * | 8/1987 | Sawada | 200/6 R |
| 5,384,441 | A * | 1/1995 | Balaban et al. | 200/339 |
| 5,749,459 | A * | 5/1998 | Balaban et al. | 200/559 |
| 5,990,436 | A * | 11/1999 | Balaban et al. | 200/559 |
| 6,339,201 | B1 * | 1/2002 | Balaban et al. | 200/339 |
| 6,903,292 | B2 * | 6/2005 | Balaban et al. | 200/339 |

* cited by examiner

*Primary Examiner*—Michael A. Friedhofer
(74) *Attorney, Agent, or Firm*—Paul J. Sutton

(57) ABSTRACT

A four function electrical rocker switch has two single pole, single throw on/off sections having their movable contact arms coupled to a single electrical line and their screw terminal fixed contacts connected to individual circuits. The two switch sections are independently operated. A third rocker switch is a single pole, double throw switch with a center-off position. The third switch can be operated to either of two positions to operate either one of two independent circuits or can be left in the center-off position not engaging either circuit. A five function electrical rocker switch can be made up of one section having a single pole, single throw on/off switch and two sections with single pole, double throw switches which each have a center-off position.

1 Claim, 19 Drawing Sheets

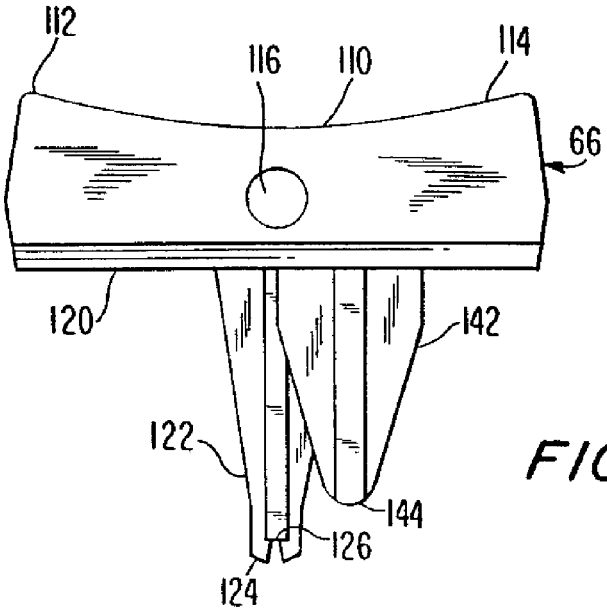
FIG.14
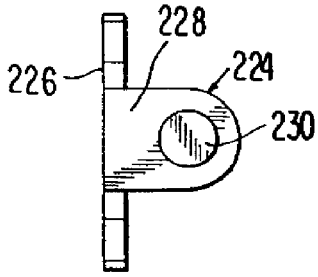
FIG.17
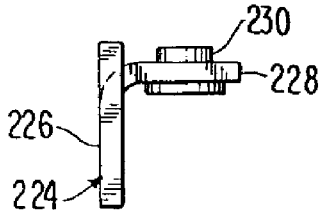
FIG.18
FIG.15
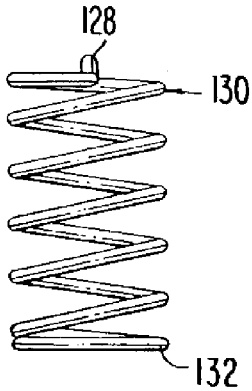
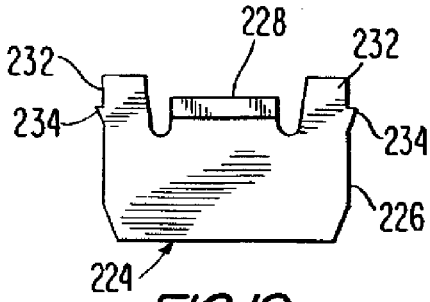
FIG.19
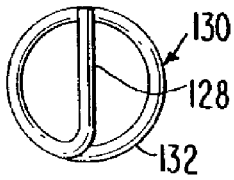
FIG.16

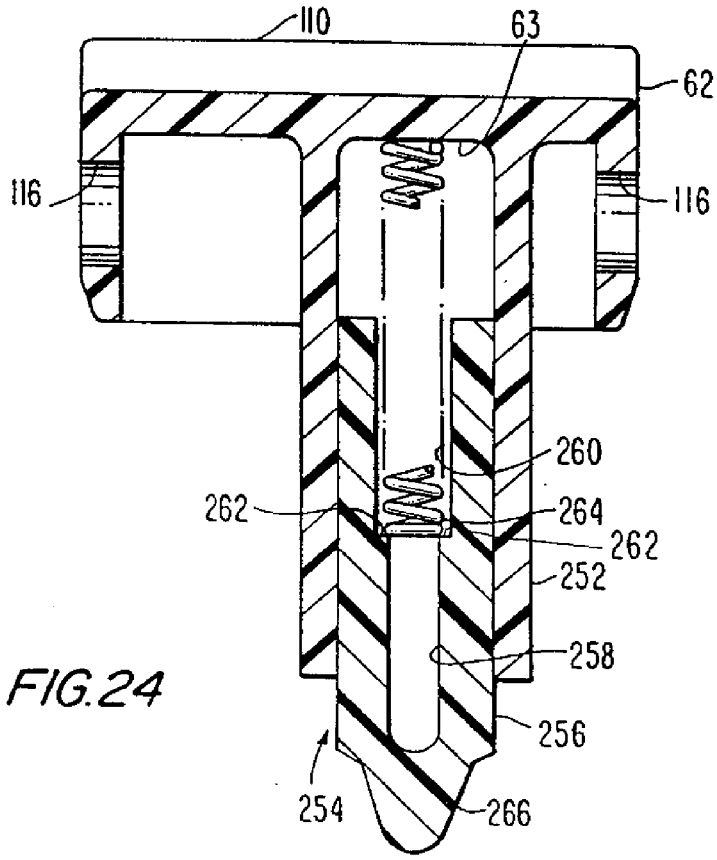
FIG. 24
FIG. 27
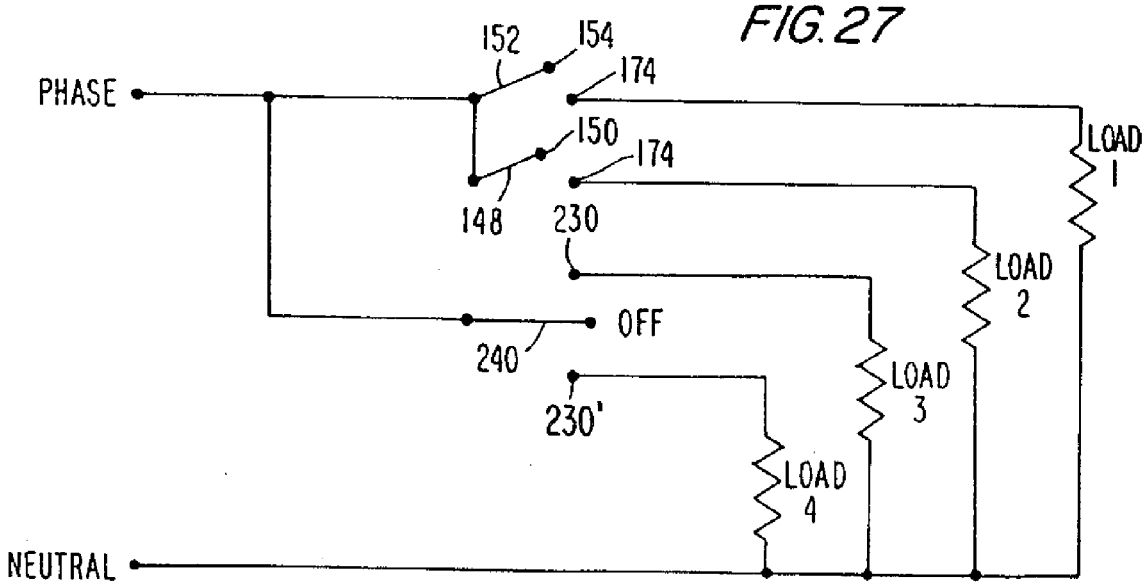

FOUR FUNCTION ELECTRICAL ROCKER SWITCH

This application is a continuation of application Ser. No. 10/047,246, filed Jan. 14, 2002, now U.S. Pat. No. 6,903,292; which is a continuation-in-part of application Ser. No. 09/235,785 filed Jan. 22, 1999 (as a Continued Prosecution Application of application Ser. No. 09/235,785 filed Jan. 22, 1999), now U.S. Pat. No. 6,339,201; which is a continuation-in-part of application Ser. No. 08/865,921 filed May 30, 1997, now abandoned.

BACKGROUND OF THE INVENTION

1. Field of the Invention

The invention deals with electrical switches, and more particularly, with multiple function electrical switches that can be placed in a single, standard gang box.

2. Description of the Prior Art

As the use of electrical equipment in the home and commercial establishments increases, there is a need to increase the number of electrical switches used for controlling or supplying electrical power to such equipment. However, much of this equipment is placed in existing structures where it is difficult to increase the number of gang boxes in which such switches can be placed or increase the number of electrical cables extending through existing walls. To provide adequate heat dissipation and to insure that all equipment is properly connected to a neutral return conductor, the number of switch devices or receptacles in each box is limited and each cable that provides electrical power to such switches and receptacles must also contain the neutral return conductor.

At present, triple rocker switches are available, each providing a single pole, single throw on-off switch and requiring two conductors for each switch unit. Thus, there are six conductors crowded into a single gang box which increases the possibility of physical contact between individual conductors or between the conductors and the gang box which may result in short-circuits. Also, the heat produced by these closely placed conductors may exceed safe levels.

One approach that reduces the crowding in the gang box and reduces the number of conductors for the switches is shown in U.S. Pat. No. 5,384,441 issued Jan. 24, 1995 and assigned to the assignee of the instant invention and by this reference incorporated into the instant application, makes use of a common phase conductor for each of the three rocker switches. Thus, the number of electrical conductors used in a gang box including such a switch arrangement is reduced to four. The number of rocker switch units, however, remains at three.

SUMMARY OF THE INVENTION

The instant invention overcomes one of the problems presented by the prior art by permitting the substitution of a single pole, double throw, center-off switch for one of the single pole, single throw on and off switches. The use of a common phase line for the two single pole, single throw switches permits these two switches to be wired using the three conductors of common three conductor cable and insures that the neutral return conductor is present in the cable to which the switches are wired.

The single pole, double throw, center-off switch can also be wired to the same three conductors used for the two single-pole, single throw switches. Thus, using the same three conductor cable, the number of switches has been increased to four. It is an object of this invention to provide a novel four function electrical rocker switch.

It is an object of this invention to provide a novel four function electrical rocker switch which can be placed within a single gang box.

It is an object of this invention to provide a novel four function electrical rocker switch which can be placed within a single gang box and wired to a single three conductor cable.

It is still another object of this invention to provide a novel four function electrical switch having two on/off single pole, single throw switches and a single pole, double throw, center-off switch.

Other objects and features of the invention will be pointed out in the following description and claims and illustrated in the accompanying drawings, which disclose, by way of example, the principles of the invention, and the best mode which is presently contemplated for carrying them out.

BRIEF DESCRIPTION OF THE DRAWINGS

In the drawings in which similar elements are given similar reference characters:

FIG. 14 is a side elevational view of the rocker of the single pole, single throw switch sections of the switch of FIG. 1.

FIG. 15 is a side elevational view of the spring employed with the rocker of FIG. 14.

FIG. 16 is a top plan view of the spring of FIG. 15.

FIG. 17 is a top plan view of the fixed contact member of the rocker of the single pole, double throw switch portion.

FIG. 18 is a side elevational view of the fixed contact member of FIG. 17.

FIG. 19 is a front elevational view of the fixed contact member of FIG. 17 with the contact removed.

FIG. 24 is a front elevational view, in section, of the rocker of the single pole, double throw center-off switch portion.

FIG. 27 is a schematic diagram of the four function electrical rocker switch of FIG. 1.

DESCRIPTION OF THE PREFERRED EMBODIMENT

Figure 13:
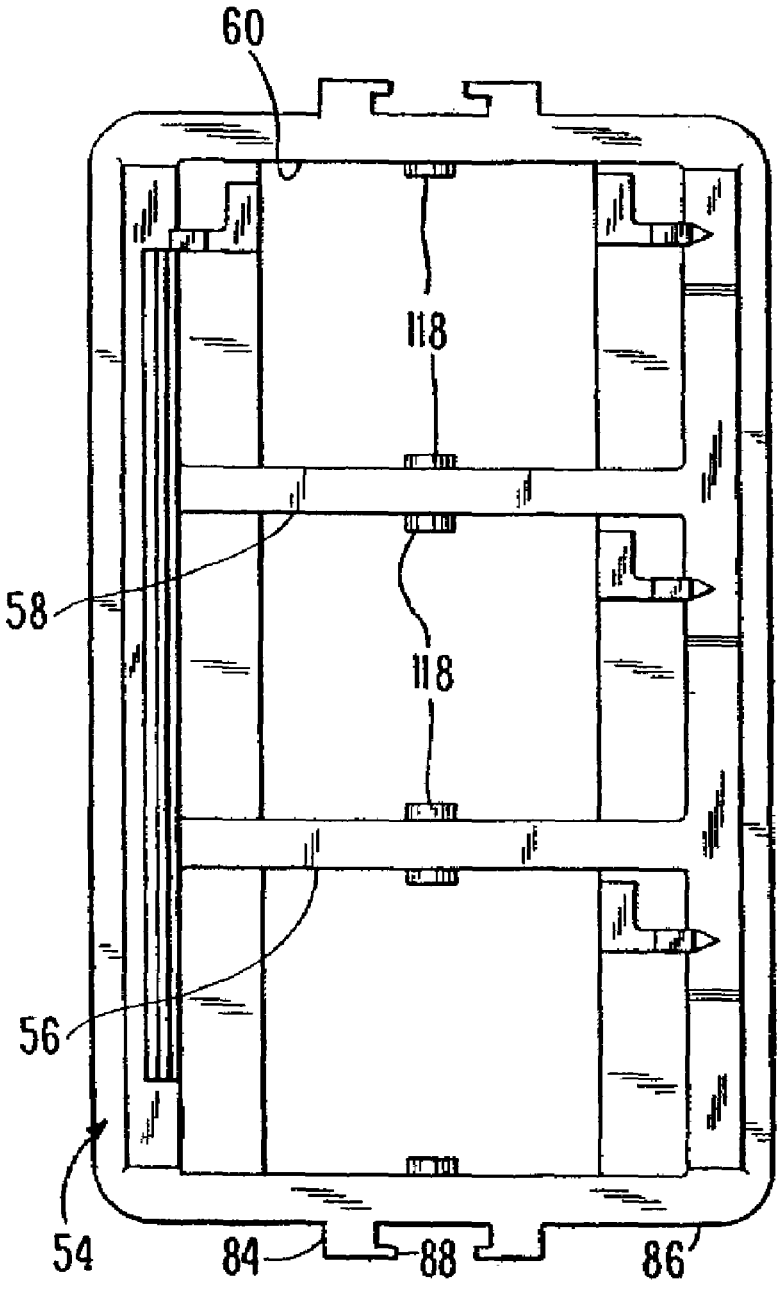
FIG. 13 is a bottom plan view of the cover of the switch of FIG. 1.

Turning now to FIGS. 1, 2, 3 and 4, there is shown the exterior of a four function electrical rocker switch 50 constructed in accordance with the concepts of the invention. A base 52, as will be described below, contains the various fixed and movable contacts and the operating means therefore. Fixed to the base 52 is a cover 54 which contains three apertures 56, 58 and 60 (see FIG. 13) through which project three rockers 62, 64 and 66, respectively. A strap 68 surrounds the cover 54 and assembles it to the base 52 and provides for mounting the switch 50 to the mounting ears of a gang box (not shown) as is well known in the art. Strap 68 has flat portions 70 at each end through which extend apertures 72 to receive mounting screws 74 to fasten switch 50 to the ears of a gang box (not shown). Threaded apertures 76 accept the threaded fasteners of a cover plate (not shown) to finish the installation of the switch 50 to a gang box. Squares of insulation 78 on fasteners 74 insulate the strap 68 from the ears of the gang box.

Tabs 80 extend from each of the flat portions 70 at right angles to such flat portions 70 and are bifurcated at their free ends 82. The tabs 80 extend between two raised ribs 84 on the end walls 86 of base 52 and within inturned ends 88 of raised ribs 84 (see FIG. 5). The two legs 83 of the tab free ends 82 are separated and peened over the bottom edges of ribs 84 to assemble the strap 68 to base 52.

The bottom 90 wall of base 52 has a series of openings 92, 94, 96, 98, 100 and 102 to receive the bared ends of individual insulated conductors (not shown). Slots 104, 106 and 108 are adjacent the openings 92, 94 and 96, respectively, to permit the release of the conductors in the openings adjacent the slots when a small flat tool blade is inserted into a slot, as will be described in more detail below.

Figure 10:
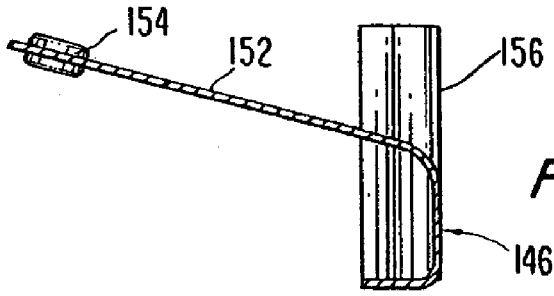
FIG. 10 is a side elevational view of the movable contact member of FIG. 9 taken along the line 10—10.
Figure 11:
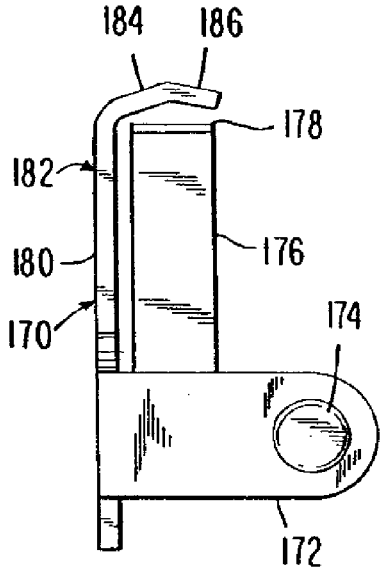
FIG. 11 is a top plan view of a fixed contact member of the switch of FIG. 1.
Figure 12:
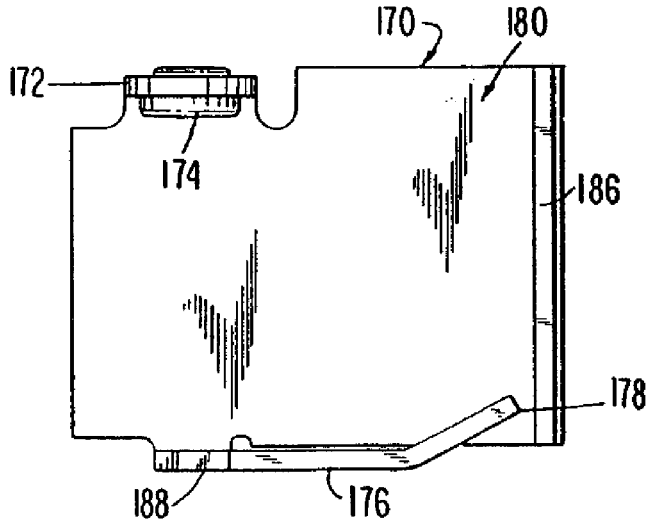
FIG. 12 is a side elevational view of the fixed contact member of FIG. 11.

Referring now to FIGS. 5 to 16, there is shown the details of the rocker switch sections operated by rockers 64 and 66. These rocker switch sections are more fully described in the aforementioned U.S. Pat. No. 5,384,441 issued Jan. 24, 1995. Rocker 66 has an upper curved surface 110 terminating at ends 112 and 114, respectively. To place the rocker 66 in one of its two stable rest positions, the upper surface 110 is depressed at either of the ends 112 and 114. Recesses 116 receive therein pivot pins 118 formed on the cover 54 walls which define the recesses 56, 58 and 60 (see FIG. 13). Extending from the bottom surface 120 of rocker 66 (see FIG. 14) is toggling arm 122 whose free end 124 contains a slot 126 to receive the straight portion 128 of toggle spring 130 (see FIGS. 15 and 16) whose other end 132 is placed about hub 136 (see FIG. 6) on the inside surface 134 of bottom 90 wall. Two spring stops 138 flank hub 136 and limit the travel of the toggle spring 130 and thus of the rocker 66 itself. Two spring rests 140 also flank hub 136, off-set from the spring stops 138 by 90° (see FIG. 5). The spring rests 140 support the free end 132 of toggle spring 130 above the inside surface 134 so that the toggle spring 130 is free to move between its two stable positions. An actuating arm 142 also extends from bottom surface 120 of rocker 66 to a free end 144 which engages the brush arm 148 of brush assembly 146, fabricated from spring stock (see FIGS. 8, 9 and 10). Brush arm 148 extends from brush backplate 156 to a free end at which is placed a movable contact 150. Contact 150 is made of a silver alloy or similar material having good conductive properties and may be installed adjacent the end of brush arm 148 by welding, brazing, crimping or the like. As shown in FIG. 10, brush arm 148 has an initial position at about 30° up from a plane perpendicular to brush backplate 156. As will be described below, this position prevents contact between movable contact 150 and its associated fixed contact except when the free end 144 of its associated actuating arm 142 engages it.

A contact arm 164 is formed with a contact surface 166 from brush backplate 156 and bent 90° with respect to the plane of the brush backplate 156 as at 168. The end of brush backplate 156 forms a clamp wall 158 which ends in two retainer sections 160 and 162, forming a chevron. The bared end of a conductor (not shown) is inserted through opening 92 and is positioned on contact surface 166 and held there by retainer sections 160 and 162. This connects the entire brush backplate 156 to the same point and by that means connects to both movable contacts 150 and 154. Thus, only a single conductor is required for both movable contacts 150 and 154 and the circuits which they form or open when rockers 64 and 66 are operated.

The fixed contacts are arranged upon fixed terminal assemblies, such as 170 made of resilient spring stock. There must be a separate fixed terminal assembly for each circuit that the rockers 64 and 66 form or open. The fixed terminal assemblies 170 each have a fixed terminal backplate 180 on which are formed a contact support arm 172 to which is attached, by welding, brazing, crimping or the like, a fixed contact 174 made of a silver alloy or other highly conductive metal. A contact arm 176 is partially severed from backplate 180 and bent 90° with respect to the plane of backplate 180 as at 188. The contact arm 176 terminates in a contact surface 178. The clamp wall 182 is formed with retainers 184 and 186 joined to form a chevron. When a solid conductor is inserted through openings 94 or 96 the bared end of the conductor generally engages the contact surface 178 and the apex between retainers 184 and 186 and is held there by the resilience of the fixed terminal assembly 170.

Figure 1:
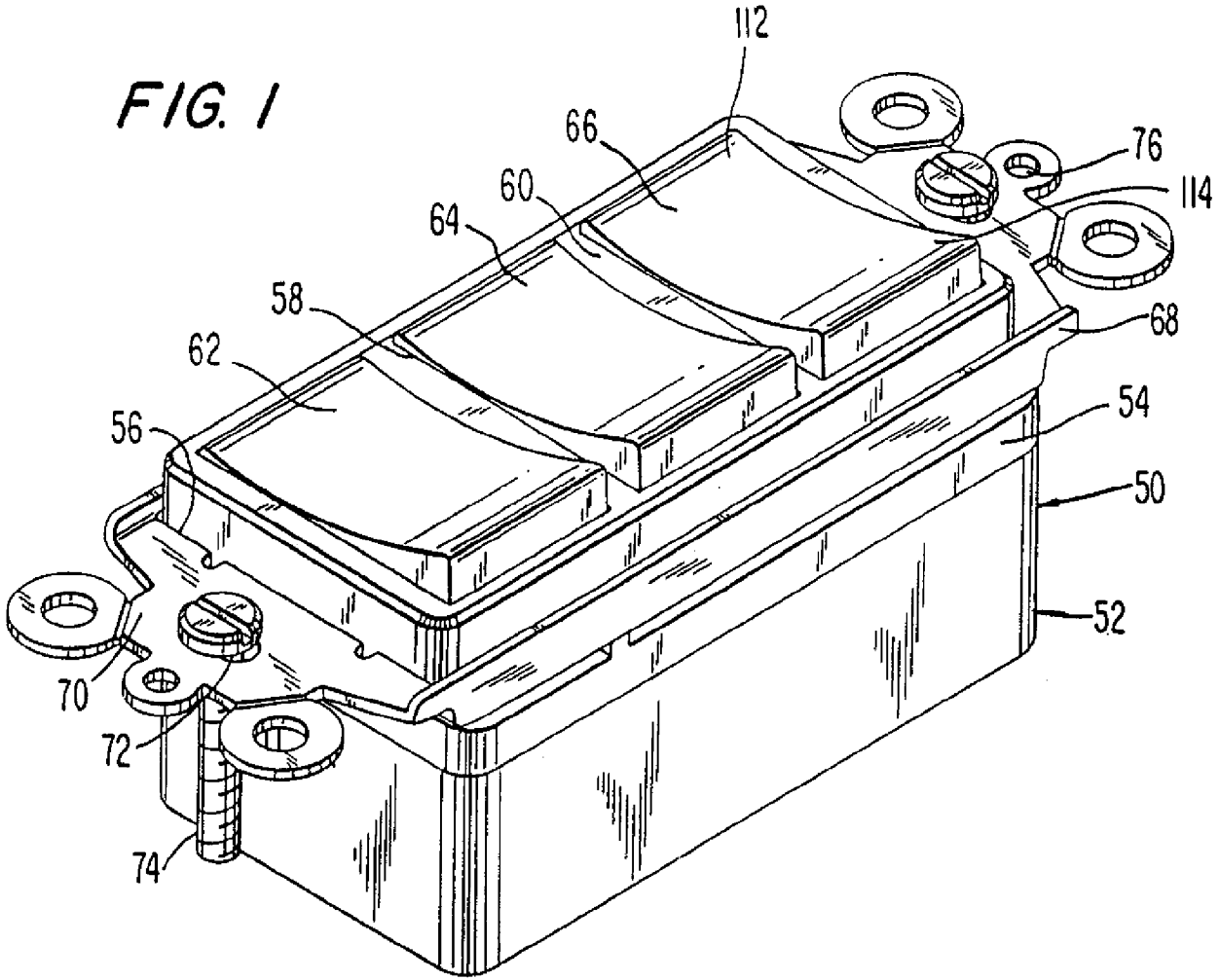
FIG. 1 is a front perspective view of a four function electrical rocker switch constructed in accordance with the concepts of the invention.
Figure 2:
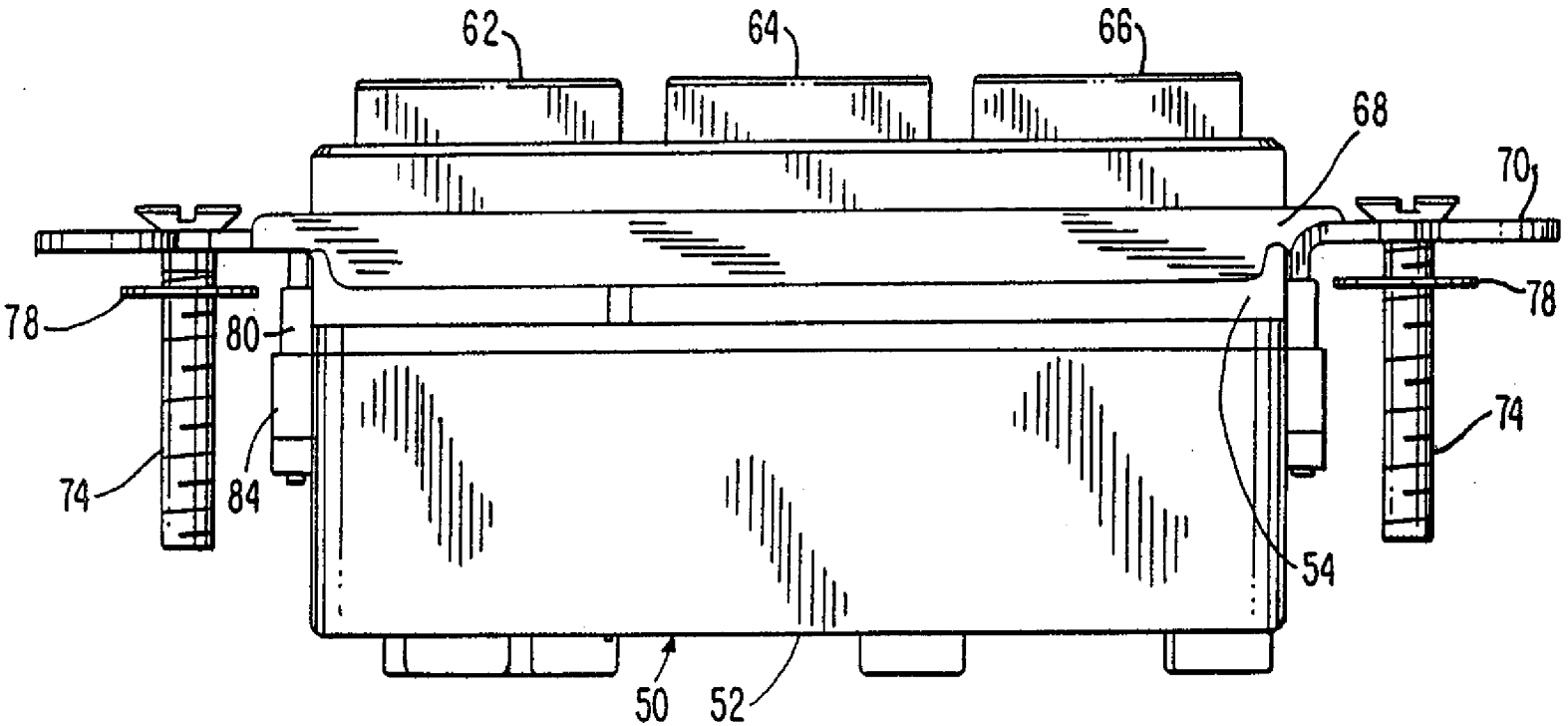
FIG. 2 is a side elevational view of the switch of FIG. 1.
Figure 3:
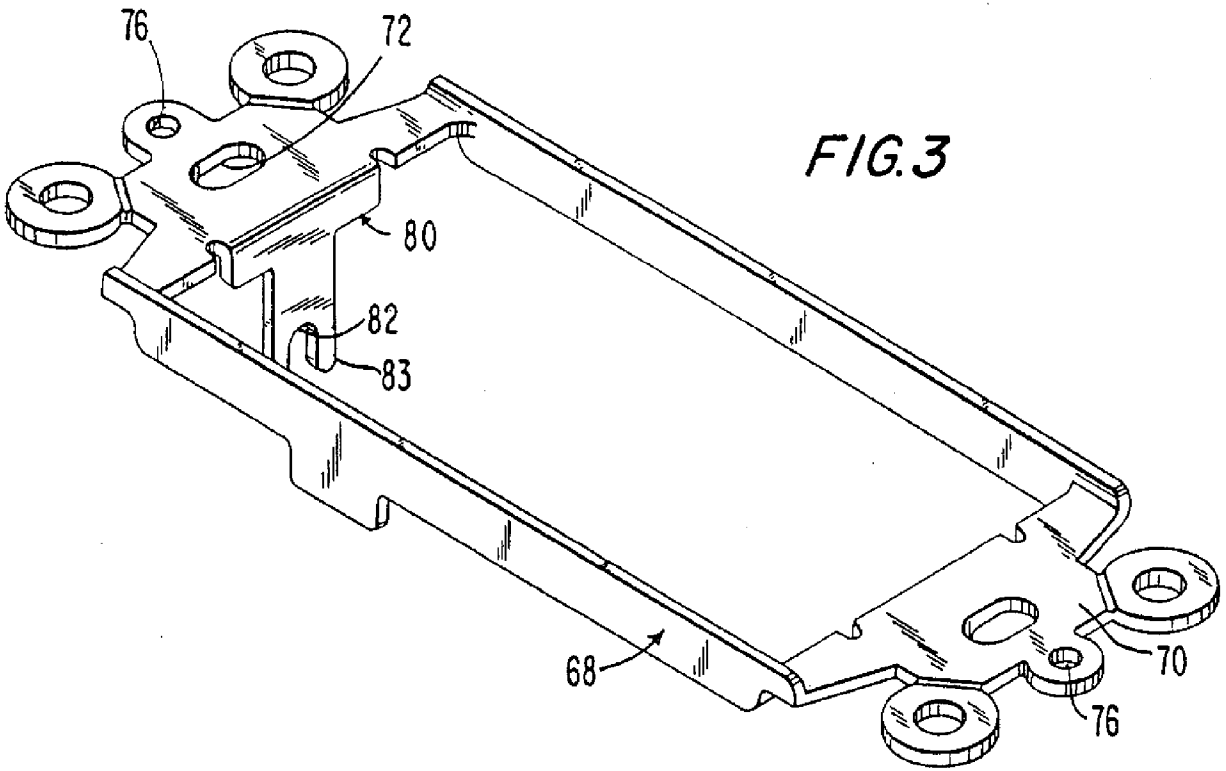
FIG. 3 is a perspective view of the mounting strap of the switch of FIG. 1.
Figure 7:
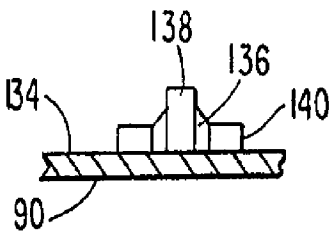
FIG. 7 is a fragmentary, side elevational view, partially in section, taken along the line 7—7 in FIG. 5.
Figure 4:
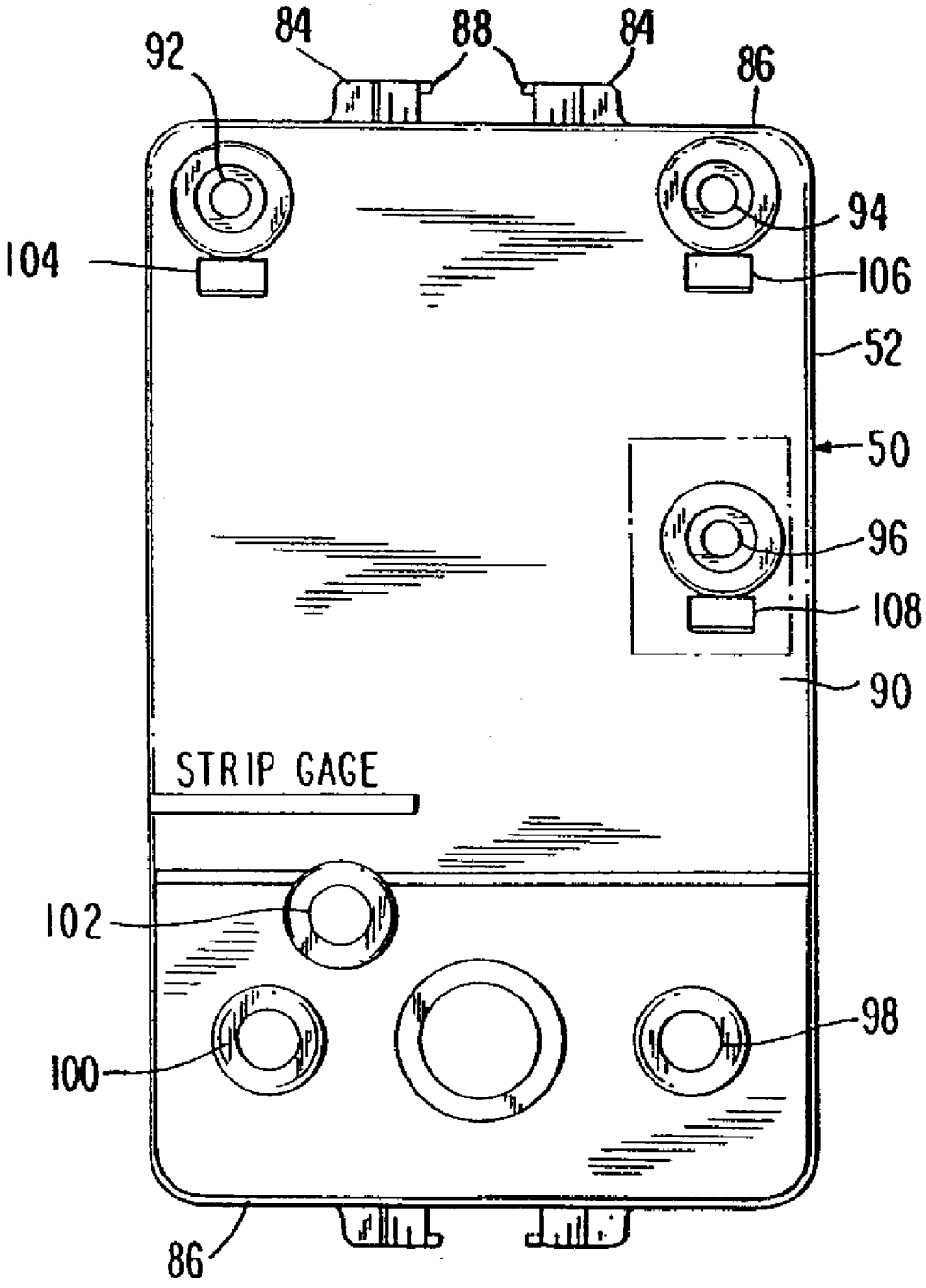
FIG. 4 is a bottom plan view of the switch of FIG. 1.

As more fully set forth in the '441 patent, when rocker 66 is positioned as it is in FIG. 1 and end 112 is depressed and end 114 is above the cover 54, the actuating arm 142 is not in contact with brush arm 152 and the natural resilience and the angle at which brush arm 152 is set permits movable contact 154 to remain out of engagement with a fixed contact 174 of fixed terminal assembly 170. Toggle spring 130 rests on the right spring stop 138. By depressing rocker 66 at end 114, the rocker 66 begins to pivot in a clockwise direction about its pivot pins 118 (see FIG. 13) and toggle spring 130 is compressed. Once the end 114 goes below its mid-point, the toggle spring 130 expands and takes a position against left spring stop 138 to define the second stable position of rocker 66. The actuating arm 142 engages brush arm 152 and closes movable contact 154 to fixed contact 174 completing the circuit.

Despite the fact that both brush arms 148 and 152 are connected to a common source, the rockers 64 and 66 can be operated separately so that both circuits, controlled by brush arms 148 and 152, can be closed or on, both open or off or one on and one off. As shown in FIG. 27, rockers 66 and 64 are in their off positions and brush arms 152 and 148 are in their open positions preventing the flow of current from the phase line to the loads 1 and 2 to the neutral line.

Figure 5:
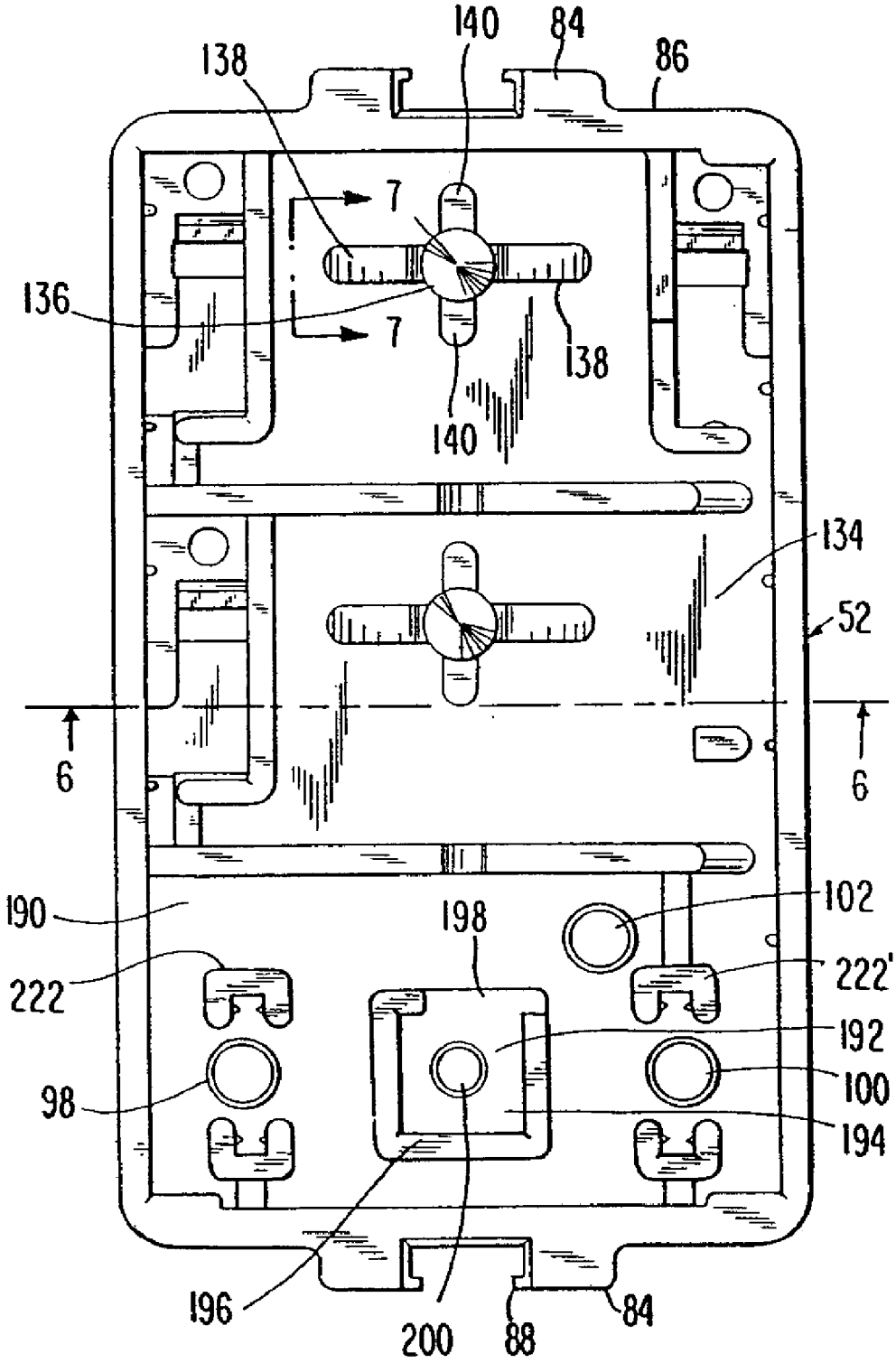
FIG. 5 is a top plan view of the inside of the base housing of the switch of FIG. 1.
Figure 6:
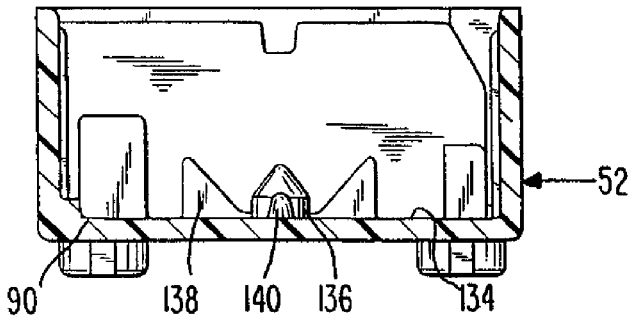
FIG. 6 is a rear elevational view, partially in section, taken along the line 6—6 of FIG. 5.
Figure 8:
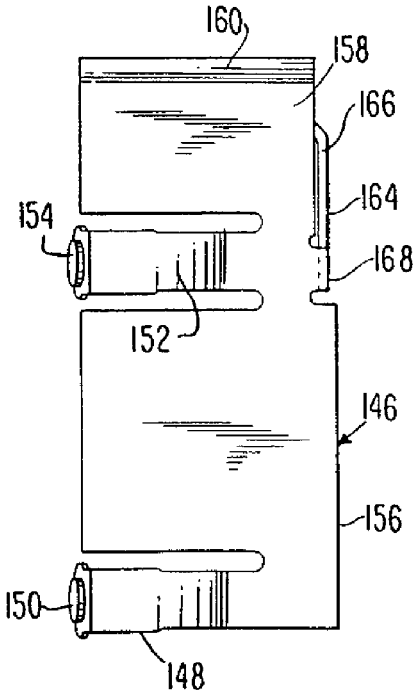
FIG. 8 is a top plan view of the movable contact member of the switch of FIG. 1.
Figure 9:
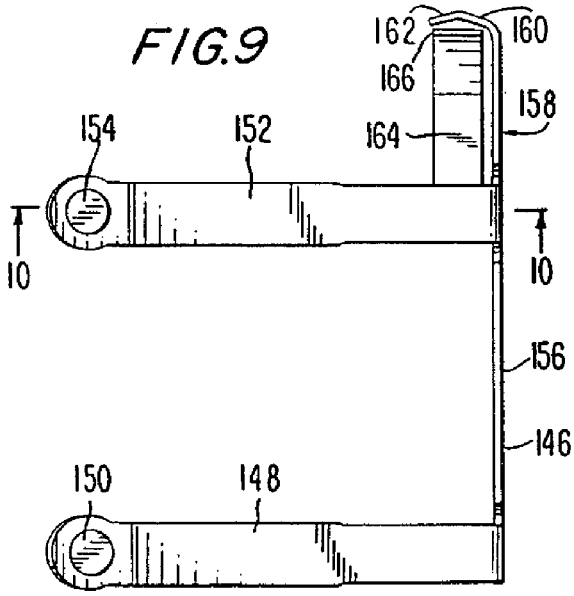
FIG. 9 is a side view of the movable contact member of FIG. 8.
Figure 20:
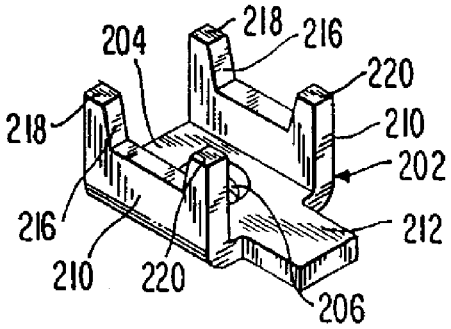
FIG. 20 is a perspective view of a cradle for the movable arms and contacts of the single pole, double throw center-off switch portion.
Figure 26:
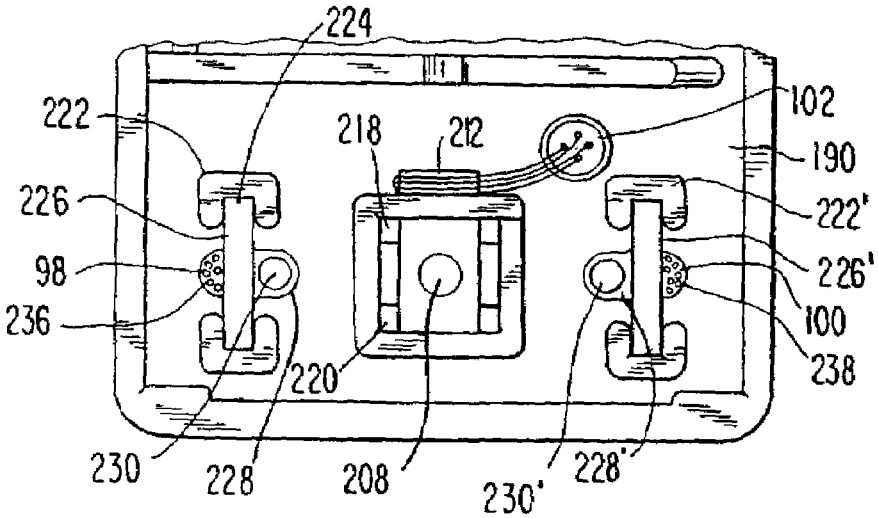
FIG. 26 is a fragmentary top plan view of the wiring of the single pole, double throw center-off switch portion.

Turning now to FIGS. 4, 5, and 17 to 27, there is shown the single pole, double throw rocker center-off switch operated by rocker 62. As shown in FIG. 5, the chamber 190, in which rocker 62 is located, does not have on inside surface 134 of bottom wall 90 a hub 136, spring stops 138 or spring rests 140. Instead it has a raised central portion 192 whose flat top portion 194 is generally surrounded by a raised wall 196 interrupted as at 198. An aperture 200 extends through flat top portion 194. A saddle 202 (see FIG. 20) having a base 204 equal in area to the bounded flat top portion 194 of raised central portion 192 has an aperture 206 aligned with aperture 200 to receive therein a rivet 208 (see FIG. 26) to fix saddle 202 to flat top portion 194 of raised central portion 192. Saddle 202 has two side walls 210 extending from two parallel marginal edges of and perpendicular to base 204. A tab 212 extends from the rear intermediate edge in the plane of the base 204. The bared end of a conductor 214 introduced through opening 102 in bottom wall 90 is soldered, welded or braised to tab 212. The side walls 210 each have slots 216 therein to define two fingers 218, 220.

Figure 30:
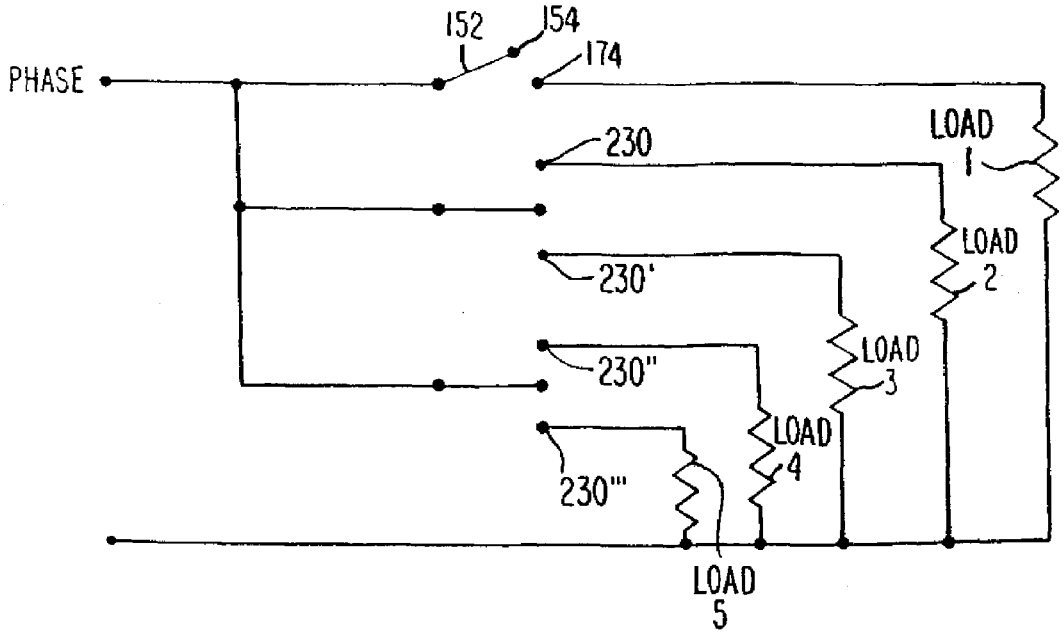
FIG. 30 is a schematic diagram of the five function rocker switch of FIG. 29.
Figure 29:
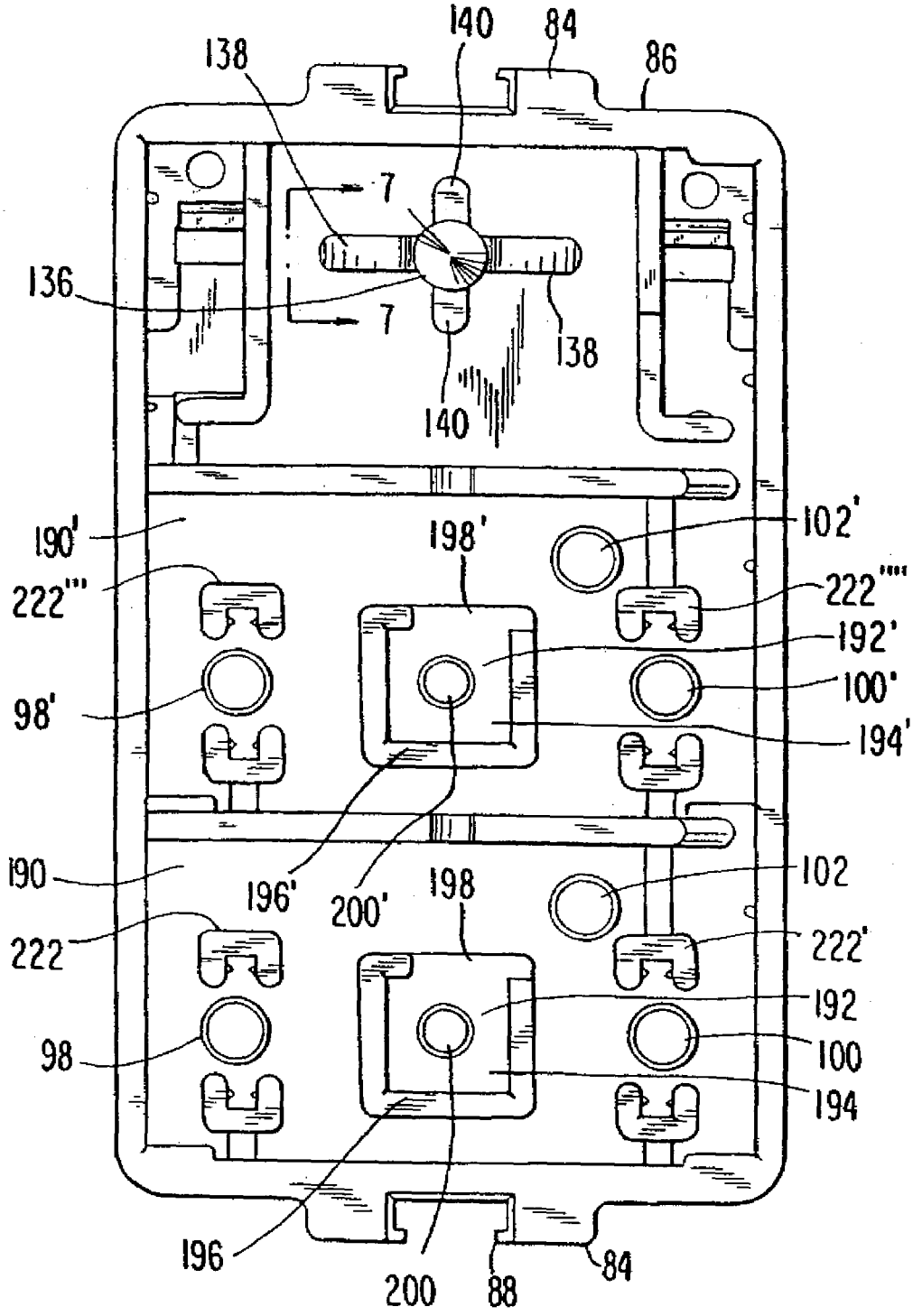
FIG. 29 is a top plan view of a modification of the instant device showing two single pole, double throw, center off switch sections.

Chamber 190 also has two sets of fixed contact supports 222 and 222' each made up of two C-shaped ribs extending upwardly from the inner surface 134 of bottom wall 90 and facing one another to receive the shoulders 232 of the fixed contact back plate 226. Cleats 234 permit the backplate 226 to be positioned in the C-shaped ribs but not removed once they are in place. The fixed contact support arm 228 extends between the C-shaped ribs and supports the fixed contact 230 adjacent fixed contact support 222. The bared end of a conductor 236 extends through opening 98 and is soldered, welded or braised to the back surface of the fixed contact back plate 226. In a similar manner fixed contact back plate 226' is positioned in the C-shaped fixed contact supports 222' and fixed by its cleats 234. The fixed contact support arm 228' extends between the C-shaped ribs of fixed contact supports 222' and supports the fixed contact 230'. The bared end of a conductor 238 extends through opening 100 and is soldered, welded or brazed to the back surface of the fixed contact back plate 226'. To produce a five function switching device a second chamber 190 is employed as shown in FIG. 29. Its schematic drawing is shown in FIG. 30.

Figure 21:
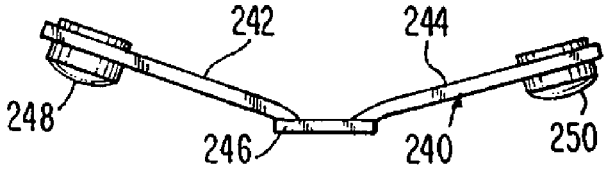
FIG. 21 is a front elevational view of the movable arms and contacts of the single pole, double throw center-off switch portion.
Figure 22:
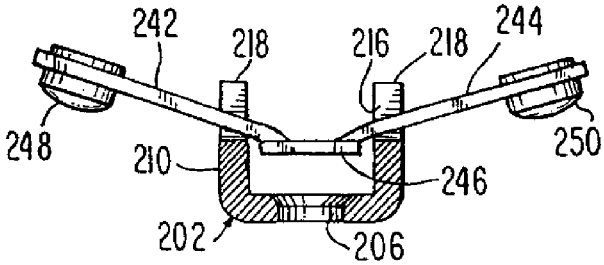
FIG. 22 is a front elevational view, partially in section, of the movable arms and contacts of FIG. 21 mounted in the cradle of FIG. 20.
Figure 28:
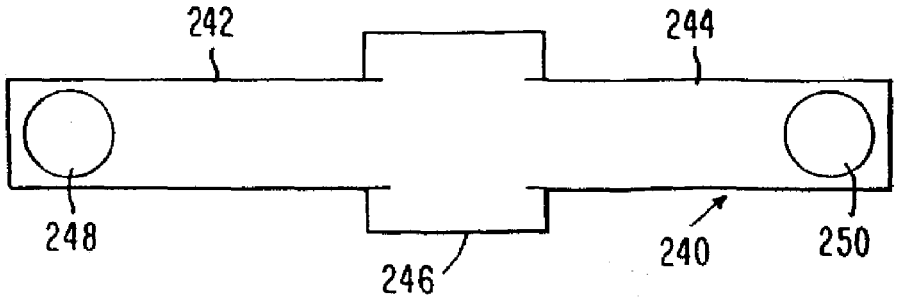
FIG. 28 is a top plan view of the movable arms and contacts of the single pole, double throw center off switch portion.

Referring now to FIGS. 21, 22 and 28, the make-up and mounting of toggle contact 240 is described. Toggle contact 240 is fabricated from a single length of stiff metal and is formed in a single punching and forming step to provide rigid arms 242 and 244. The arms 242 and 244 are slightly narrower than the slots 216 and can move within such slots 216. Adjacent the center of contact 240 is an enlargement 246 which is wider than the slots 216 and which can engage the fingers 218 and 220. The length of the enlargement 246 along the contact 240 is less than the spacing between side walls 210 and thus the contact 240 can move to a limited degree within saddle 202. When the plunger, to be described below, rests above the enlargement 246, the rocker 62 is in a static central position with ends 112 and 114 equally above the surface of cover 54. This is an off position for rocker 62 and is identified as the center-off position. Fastened to the free end of arm 242 is movable contact 248 and a contact 250 is fastened to the free end of arm 244. The contacts 248 and 250 are made of a silver alloy or other highly conductive metal and may be attached by welding, brazing, crimping or the like. In the center-off position movable contact 248 does not engage fixed contact 230 and movable contact 250 does not engage fixed contact 230'.

The toggle contact 240 is placed in the saddle 202 with enlargement 246 generally centered between side walls 210 with each of the arms 242, 244 extending through a separate one of the slots 216 between fingers 218, 220. The arms 242, 244 are free to move within their associated slots 216. As shown in FIG. 28, the enlargement 246 is wider than the slots 216 and thus enlargement 246 acts to limit movement of toggle contact 240 in saddle 202 as well as limit movement of the enlargement 246 in saddle 202. The saddle 202 is connected to one line of an AC power source (not shown) by means of a conductor 214 fastened to tab 212 making the entire saddle 202 electrically hot.

Figure 23:
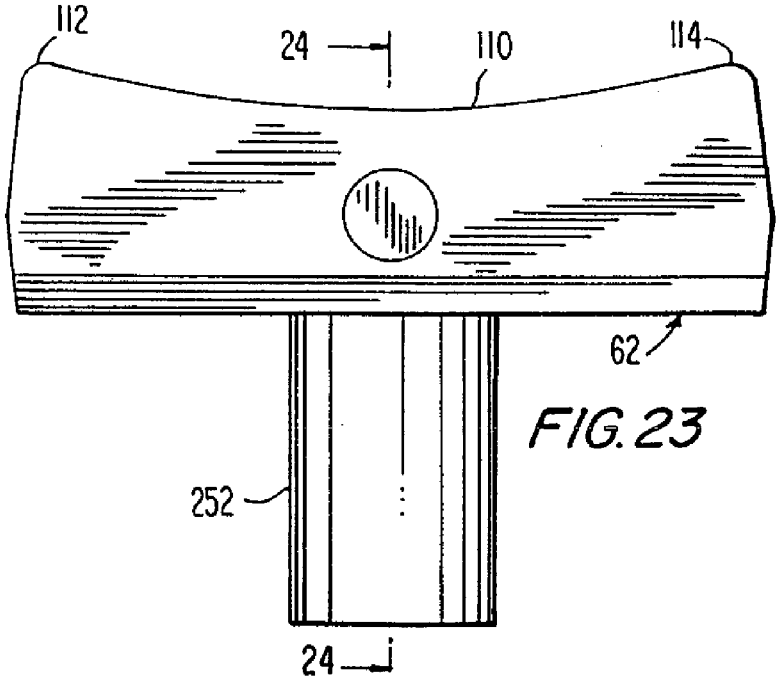
FIG. 23 is a side elevational view of the rocker of the single pole, double throw center-off switch portion of the switch of FIG. 1.
Figure 25:
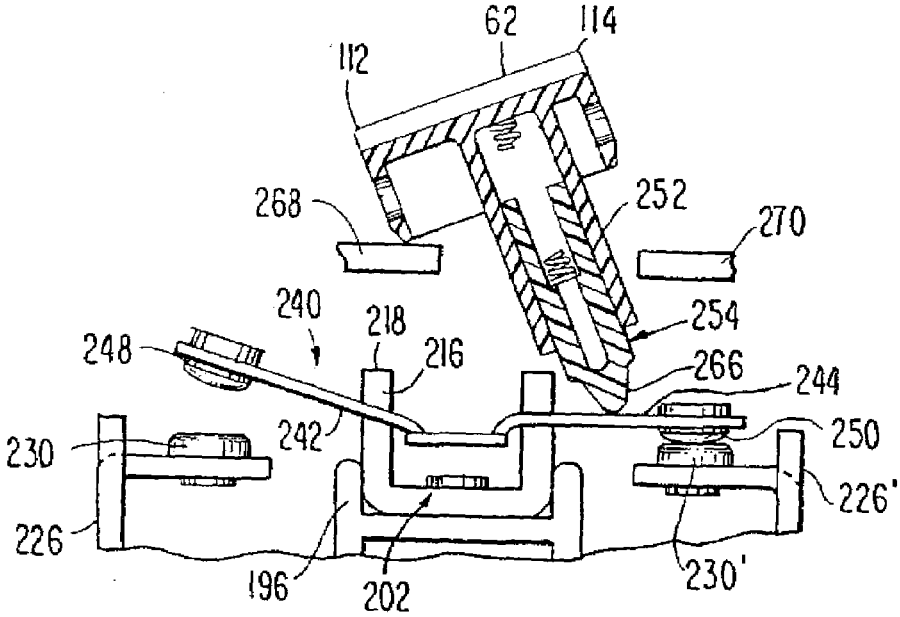
FIG. 25 is a side elevational view, partially in section, of the rocker assembly and contacts of the rocker of the single pole, double throw center-off switch portion in a closed position.

Rocker 62 is shown in FIGS. 23, 24 and 25. Rocker 62 is different than rockers 64 and 66 and employs a spring loaded plunger which serves to fix the two stable rest positions of the toggle contact 240 and moves the arms 242 and 244 to close the movable contacts 248, 250 and associated fixed contacts 230, 230', respectively. Rocker 62 has a curved top surface 110 with ends 112 and 114 and two recesses 116 to receive the pivot pins 118 of cover 54. A hollow sleeve 252 extends downwardly as shown in FIG. 24. The cylindrical portion 256 of plunger 254 is positioned in and free to move within sleeve 252. A first bore 258 in plunger cylindrical portion 256 communicates with a second bore 260 of a greater diameter to provide a shoulder 262 where bores 258 and 260 meet. A compression spring 264 extends between shoulder 262 and the interior wall 63 of rocker 62 to urge the plunger 254 out of sleeve 252. Plunger 254 has a tapered free end 266 which engages the arms 242, 244 to close the movable contacts 248, 250 to the fixed contacts 230, 230', respectively. The tapered free end 266 is so dimensioned that it can travel along substantially the entire length of arms 242 and 244 and within slots 216 between fingers 218, 220. The plunger 254 cannot be ejected from sleeve 252 because the recesses 116 engage the pivot pins 118 to prevent rocker 62 from coming out of aperture 56 at the top and the engagement of the tapered free end 266 of the plunger 254 with the toggle contact 240 prevents ejection of plunger 254 from sleeve 252.

Assuming that rocker 62 is initially in the center-off position, that is with ends 112, 114 at the same distance above cover 54 and the cylindrical portion 256 of plunger 254 is over the enlargement 246, movable contacts 248 and 250 are both spaced from their associated fixed contacts 230, 230' and both possible circuits are open. Depressing rocker 62 at end 112 causes rocker 62 to pivot in a counterclockwise direction about pivot pins 118. The cylindrical portion 256 of plunger 254 exits through slot 216 of saddle 202 between fingers 218, 220 and along arm 244. The toggle contact 240 shifts its position so that movable contact 250 on arm 244 pivots about the base of slot 216 and engages the fixed contact 230'. The enlargement 246 shifts position to engage the inner surfaces of the fingers 218, 220 of the left sidewall 210. Movement of the toggle contact 240 causes the movable contact 250 to wipe the surface of fixed contact 230' and remove dirt, oxides and other contaminants. Since the toggle contact 240 is rigid the movement of movable contact 250 to engage fixed contact 230' causes the arm 242 to pivot in a counterclockwise direction, as shown in FIG. 25, and further separate movable contact 248 from fixed contact 230. Movement of rocker 62 continues until a stop 268 is engaged by the rocker 62. At this point a solid contact exists between movable contact 250 and fixed contact 230'. The rocker 62 can be engaged at end 114 and moved to the center-off position or to the second closed position between movable contact 248 and fixed contact 230. Stop 270 controls clockwise pivoting of rocker 62.

FIG. 27 shows the operation of rocker 62, as described above, in schematic form. Toggle contact 240 is shown in its center-off position and can be moved to engage fixed contact 230 to close the path from the phase line through load 3 to the neutral line or engage fixed contact 230' to close the path from the phase line through load 4 to the neutral line. Thus, using the three rockers 62, 64 and 66 the path to both loads 1 and 2 can be closed and one of the paths to loads 3 and 4 can be closed.

Although a switching device is shown with one or two single pole, single throw switches and one or two single pole, double throw, center-off switches, any combination of single pole, single throw switches and single pole, double throw, center-off switches may be employed.

FIGS. 31–40 show an alternate embodiment of the present invention whereby the movable contact member (hereinafter "brush assembly") 146A and fixed contacts have apertures for receiving fasteners (e.g., screws, rivets, pins). Thus, the fixed contacts are part of screw terminal assemblies (hereinafter "screw terminals"). The screw terminals can use any well known fasteners for electrically connecting wires thereto. Thus, the screw terminals are not limited to the use of screws as fasteners. Also, a slot opening now present in the brush assembly of this alternate embodiment of the present invention allows said brush assembly also to be used as a screw terminal. That is exposed ends of electrical wiring can now be fastened to these terminals with the use of screws (or other types of fasteners) inserted through the apertures or slots. Also, the alternate embodiment of the present invention modifies base housing 52 so as to provide sidewall openings to accommodate the screw terminals as described below.

Figure 31:
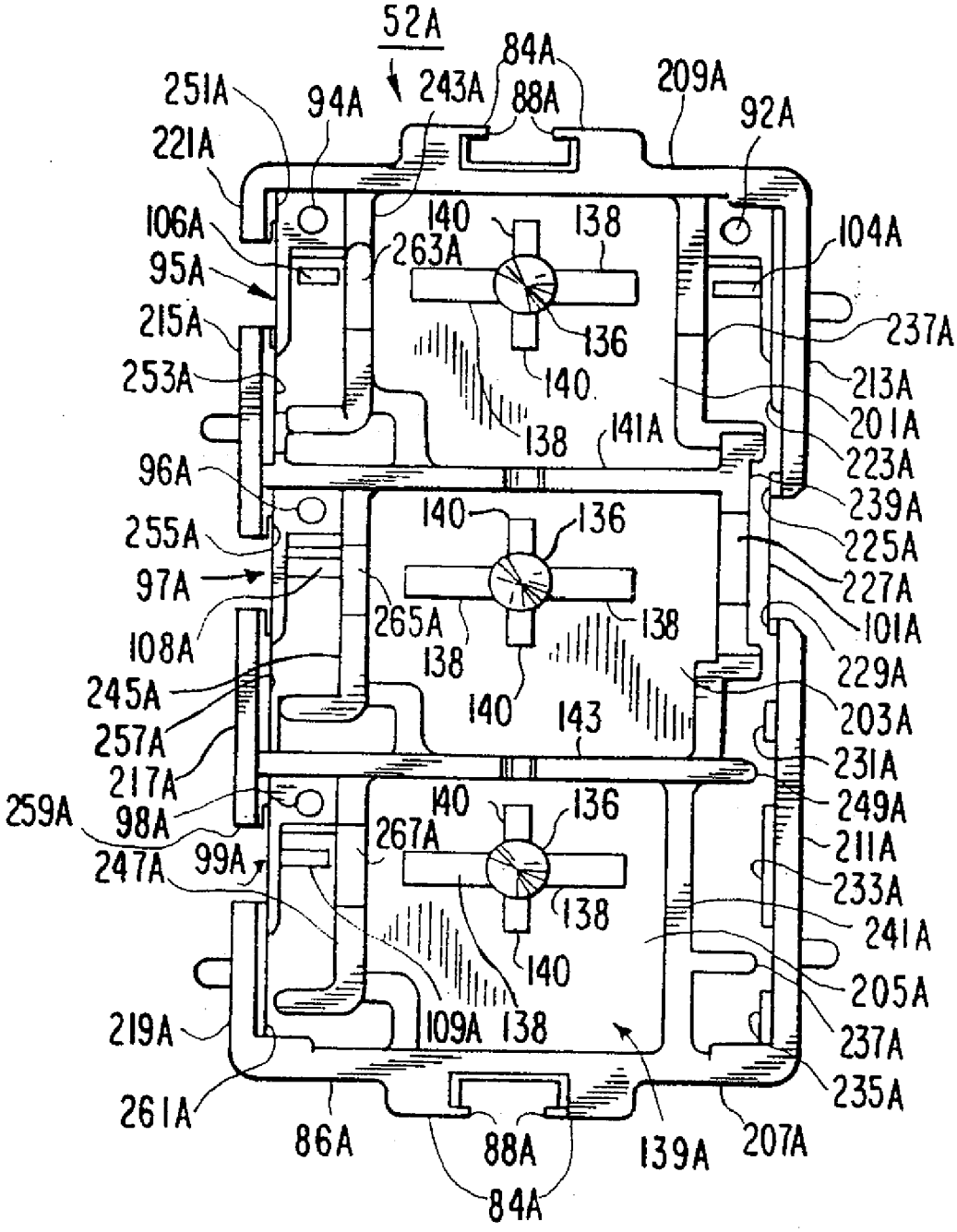
FIG. 31 is a top plan view of the inside of the base housing of the alternate embodiment of the switch of the present invention.
Figure 32:
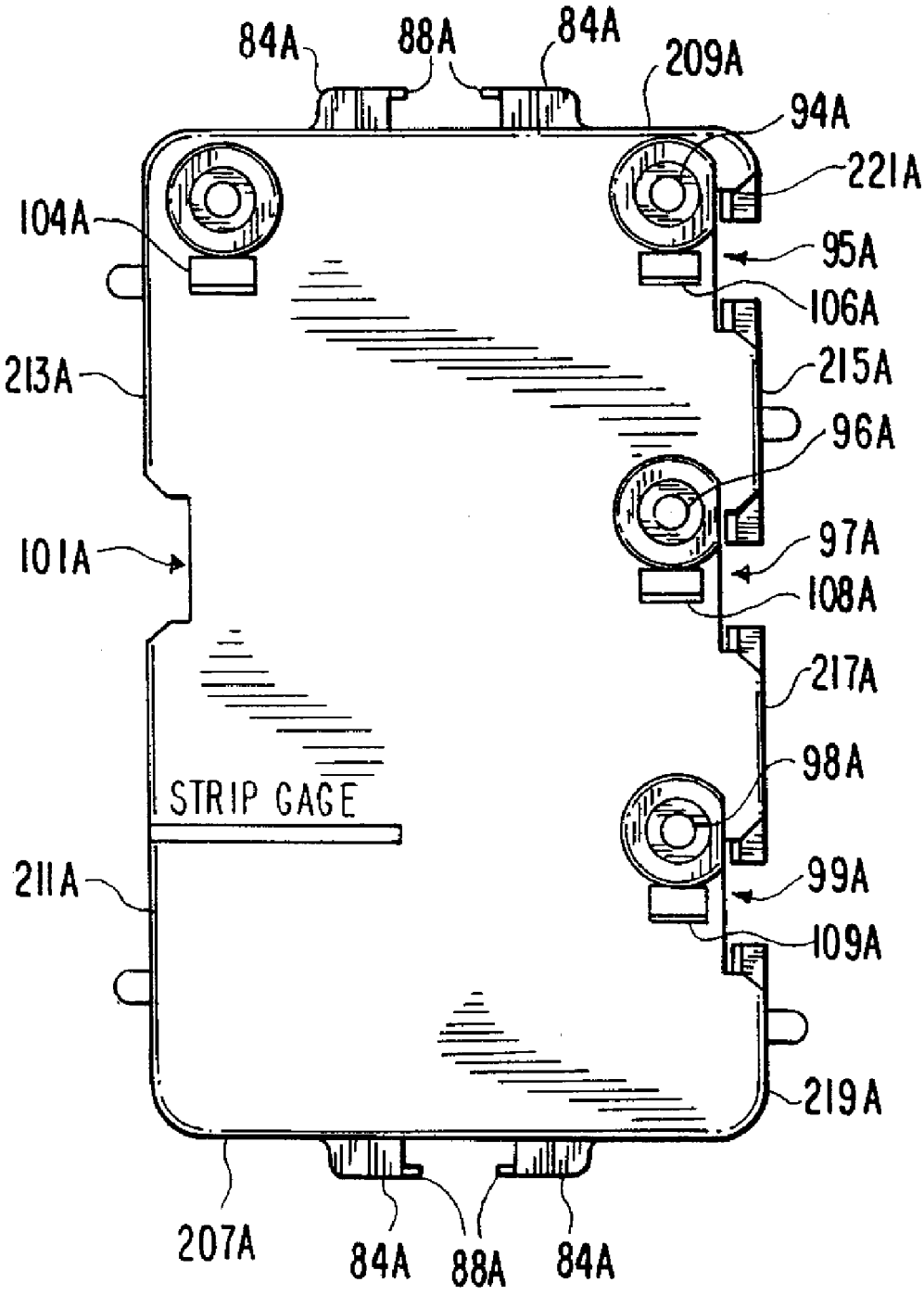
FIG. 32 is a top plan view of the bottom of the base housing of FIG. 31.

FIGS. 31 and 32 show top and bottom plan views of a base housing of the alternate embodiment of the present invention. Base housing 52A has end walls 209A and 207A, left side wall portions 221A, 21 5A, 217A and 219A. End walls 209A and 207A have raised ribs 84A with inturned ends 88A. Base housing 52A further has right side wall portions 213A and 211A and base floor 139A. Partitions 141A and 143A vertically extend from base floor 139A to form chambers 201A, 203A and 205A. As in housing 52 of FIG. 5, each chamber contains spring stops 138 that flank hub 136. Two spring rests 140 also flank hub 136. The side wall portions form side wall openings 95A, 97A, 99A on the left side of the base housing and side wall opening 101A on the right side of the base housing. Along the left side wall, partitions 243A, 245A and 247A form compartments in which screw terminals are disposed. Partitions 237A, 239A and 241A form a compartment along the right side of the base housing 52A for placement of the brush assembly of FIGS. 38 and 40. On the left side of base housing 52A, partition 243A has opening 263A, partition 245A has opening 265A and partition 247A has opening 267A. On the right side of base housing 52A, partition 239A has opening 227A. The openings in the partitions allow a screw or other well known fastener to extend through after having been inserted through an aperture of a screw terminal as described below. Base floor 139A has openings 92A, 94A, 96A and 98A for receiving the bared ends of individual insulated conductors (not shown). Slots 104A, 106A, 108A and 109A are adjacent to openings 92A, 94A, 96A and 98A respectively, to permit the release of the conductors in the openings adjacent the slots when a small flat tool blade is inserted into a slot as described above. The compartments on the left side of base housing 52A have terminal guides 251A, 253A, 255A, 257A, 259A and 261A. The compartments on the right side of base housing 52A have terminal guides 223A, 225A, 229A, 231A, 233A and 235A and partition guide portions 237A and 249A. The terminal guides as shown are located on the inner side of the side wall portions. These guides are thin strips that run vertically from base floor 139A to near the top of their respective side wall portions. The screw terminals and the brush terminals are wedged between their respective partitions, partition portions and guides during the manufacture of this alternate embodiment of the present invention. The side wall openings allow a portion of the screw terminals and a portion of the brush assembly to be exposed such that a screw (or other well known fastener) can be inserted in the openings of the screw terminals and brush assembly.

Figure 34:
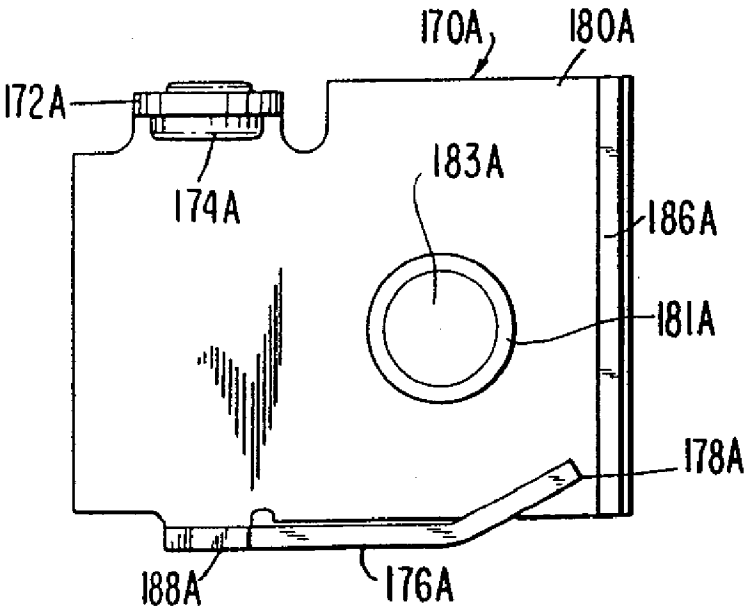
FIG. 34 is a right side elevational view of the screw terminal of FIG. 33.
Figure 33:
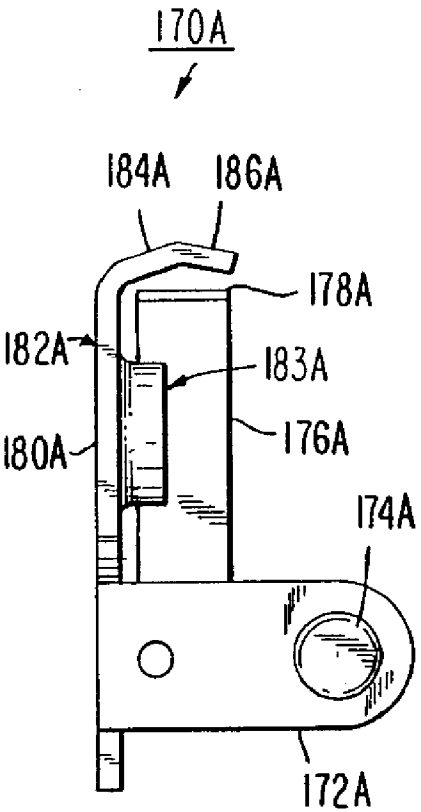
FIG. 33 is a top plan view of a screw terminal of the alternate embodiment of the present invention.
Figure 35:
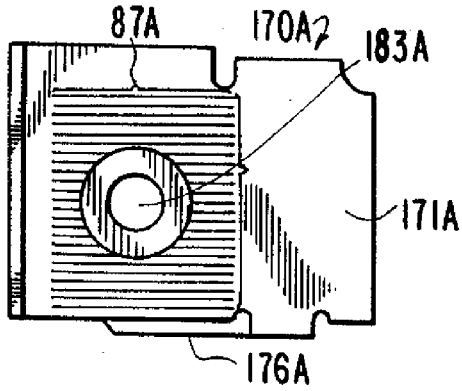
FIG. 35 is a left side elevational view of the screw terminal of FIG. 33.

Referring now to FIGS. 33–35, there are shown different views of a screw terminal 170A. Screw terminal 170A has a backplate 180A on which is formed a contact support arm 172A to which is attached, by welding, brazing, crimping or the like, a fixed contact 174A made of a silver alloy or other highly conductive metal. A contact arm 176A is partially severed from back plate 180A and bent 90° with respect to the plane of backplate 180A at 188A. The contact arm terminates in a contact surface 178A. The clamp wall 182A with retainers 184A and 186A joined to form a chevron. When a solid conductor is inserted through openings, 94A, 96A or 98A (see FIG. 32), the bared end of the conductor generally engages the screw terminal surface and the apex between retainers 184A and 186A and is held there by the resilience of the screw terminal assembly 170A. Electrical conducting wires can also be fastened to screw terminal 170A with the use of aperture 183A where funnel 183A extending about aperture 183A and integral with backplate 180A. Serrations 87A are etched onto a portion of the outer surface 171A of backplate 180A so as to surround opening 183A. The serrations are added to increase the friction between the head of a screw (not shown) inserted through opening 183A and backplate 180A.

Figure 38:
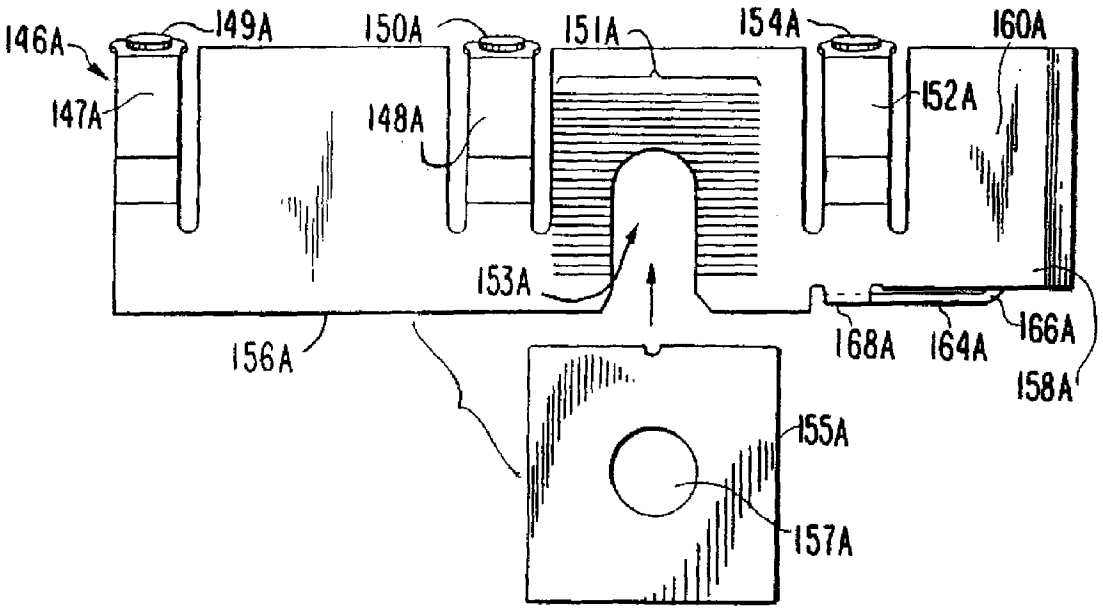
FIG. 38 is a top plan view of the movable contact member of the alternate embodiment of the present invention with a screw plate being positioned relative to the movable contact member.
Figure 39:
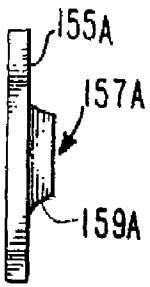
FIG. 39 is a side view of the screw plate shown in FIG. 38
Figure 40:
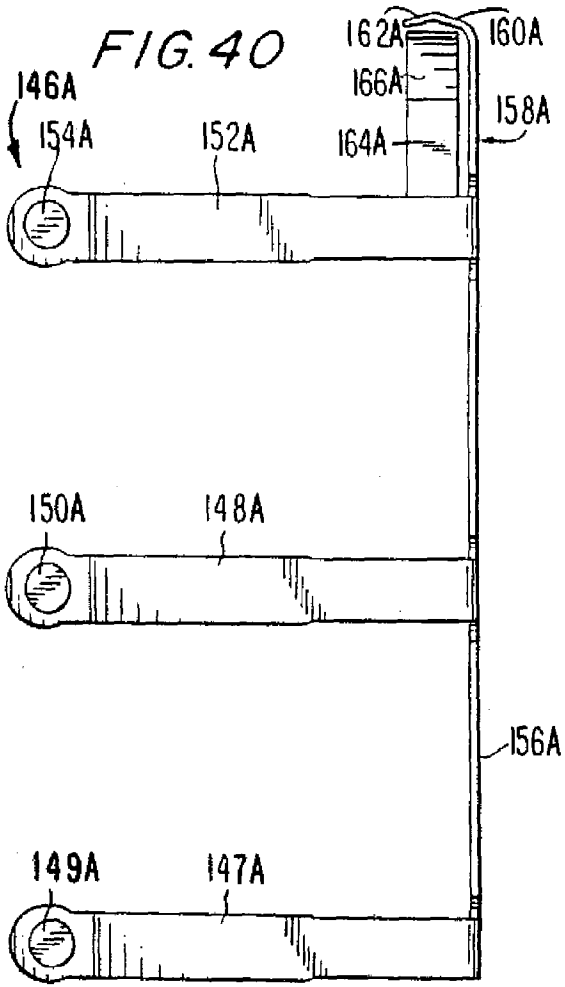
FIG. 40 is a side view of the movable contact member shown in FIG. 38.

Referring now to FIGS. 38 and 40, there are shown brush assembly 146A fabricated from spring stock. Brush arms 147A, 148A and 152A extend from brush backplate 156A to free ends at which are placed contacts 149A, 150A and 154A respectively. Contacts 149A, 150A and 154A are made of a silver alloy or similar material having good conductive properties and may be installed adjacent the end of brush arms 147A, 148A and 152A by welding, brazing, crimping or the like. A contact arm 164A is formed with a contact surface 166A from brush backplate 156A and bent 90° with respect to the plane of the brush backplate 156A at 168A. The end of brush backplate 156A forms a clamp wall 158A which ends in two retainer sections 160A and 162A. This connects the entire brush backplate 156A to the same point and by that means connects to all three movable contacts 149A, 150A and 154A and the circuits which they form or open when rockers 64 and 66 are operated. Brush assembly 146A has a slot 153A about whose periphery are etched serrations 151A. A screw plate 155A having opening 157A is shown being positioned behind brush assembly 146A so that a portion of screw plate 155A and opening 157A are exposed through slot 153A. Once brush assembly 146A is positioned as shown and placed in the compartment on the right side of base housing unit 56A, a screw (or other well known fastener) is inserted through side wall opening 101A, slot 153A and opening 157A and extends through brush terminal partition slot 227A. A side view of screw plate 155A is shown in FIG. 39 in which funnel 159A is formed integrally with screw plate 155A.

Figure 36:
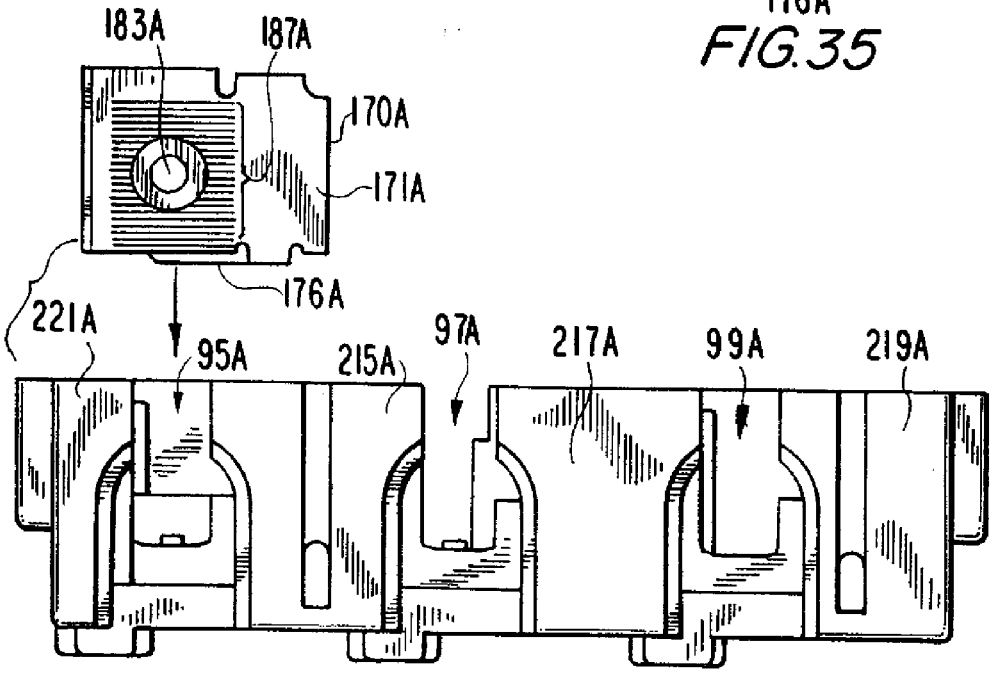
FIG. 36 is a left side elevational view of the base housing of FIG. 31 and a screw terminal being inserted in said housing.
Figure 37:
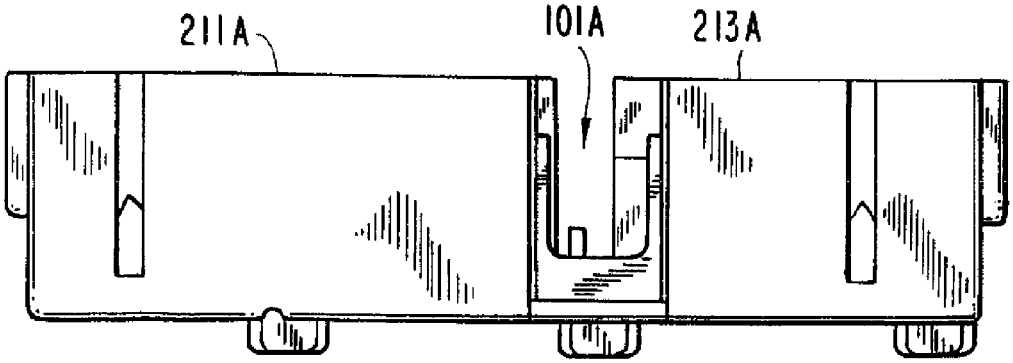
FIG. 37 is a right side elevational view of the base housing of FIG. 31.

Referring now to FIGS. 36 and 37, there are shown the left side wall and right side walls respectively of base housing 52A. FIG. 36 shows how a screw terminal is positioned in one of the screw terminal compartments. Side wall openings 95A, 97A and 99A have wider gaps near base floor 139A of base housing 52A. The side wall openings taper to narrower gaps as they extend toward the top of their respective side wall portions. Also, portions of the side wall surfaces that form the side wall openings are beveled so as to better engage with a fastener that has been inserted though said opening and a part of which is resting on the sidewall portions. For example, when a screw (not shown) is inserted through a side wall opening, the bottom of the screw head engages with the beveled surface. Specifically, when a screw terminal is inserted in the compartment formed by partition 243A end wall 209A, side wall portions 221A and 251A (see FIG. 31), opening 183A of the screw terminal is exposed through side wall opening 95A. A screw (or other well known fastener) can then be inserted through sidewall opening 95A and terminal opening 183A. A portion of the inserted screw (not shown) extends through partition slot 263A (see FIG. 31). The bottom of the head of the inserted screw engages with the beveled surfaces of slot wall portions 221A and 215A and with serrations 87A of the screw terminal. The diameter of the inserted screw is wider than the narrow gap formed by the side wall portions to prevent a fully inserted screw from traveling upwards once inserted. A similar arrangement of the screw, and screw terminal exists for side wall openings 97A and 99A. In like manner, brush assembly 146A is inserted in brush terminal compartment along the right side of base housing 52A so that slot 153A of brush assembly 146A is exposed through side wall opening 101A. As previously described, screw plate 155A is inserted behind slot 153A of brush assembly 146A and a screw (not shown) or other well known fastener is inserted through side wall opening 101A, slot 153A and screw plate opening 157A and extends through partition slot 227A as previously described. Thus, the alternate embodiment of the present invention allows the brush assembly and the fixed contacts to be used as terminals with the use of fasteners such as screws.

While there have been shown and described and pointed out the fundamental novel features of the invention as applied to the preferred embodiments as are presently contemplated for carrying them out, it will be understood that various omissions and substitutions and changes of the form and details of the device illustrated and in its operation may be made by those skilled in the art, without depending from the spirit of the invention.

We claim:

1. A four function electrical rocker switch comprising:

a) a first rocker section having a first single pole, single throw switch having a first movable arm with a first movable contact thereon and a first contact of a screw terminal coupled to a first side of a first electrical load;

b) a second rocker section having a second single pole, single throw switch having a second movable arm with a second movable contact thereon and a second contact of a screw terminal coupled to a first side of a second electrical load;

c) said first and second movable arms coupled to a phase line of a source of AC power;

d) a third rocker section having a rocker coupled to a sleeve and a center-off, single pole, double throw switch having third and fourth movable arms with third and fourth movable contacts thereon, the third and fourth moveable arms being slidably coupled to a spring loaded plunger adapted to move in and out of said sleeve as the rocker is pivoted about the center off position, said third and fourth moveable arms formed generally into a shallow v-shape with an enlarged planar section connected to the third and fourth arms at the center with the enlarged planar section having a width greater than the width of either arm, a third moveable arm support saddle for supporting the third and fourth moveable arms, a third contact of a screw terminal coupled to a first side of a third electrical load and mounted in a fixed relationship to said third moveable arm support saddle, and a fourth contact of a screw terminal coupled to a first side of a fourth electrical load and mounted in a fixed relationship to said third moveable arm support saddle, said third moveable arm coupled to said phase line through said third moveable arm support saddle, wherein the third and fourth moveable arms are urged by said spring loaded plunger as the rocker is pivoted about the center off position to both pivot and slide in and relative to the third moveable arm support saddle, the extent of said sliding movement being limited by contact of the enlarged planar section of the third moveable contact arm with the third moveable arm support saddle;

e) a second side of each of said first, second, third and fourth electrical loads coupled to a neutral conductor of said source of AC power via a screw terminal, whereby AC power can be supplied to said first electrical load, said second electrical load and one of said third and fourth electrical loads or neither of said third and fourth electrical loads.

* * * * *